United States Patent [19]

Wassermann

[11] 4,045,281

[45] Aug. 30, 1977

[54] METHOD FOR PREVENTING WEB REWETTING

[75] Inventor: Eberhard Wassermann, Sheffield, England

[73] Assignee: Sulzer Bros. (U.K.) Limited, Farnborough, England

[21] Appl. No.: 599,394

[22] Filed: July 28, 1975

[30] Foreign Application Priority Data

Aug. 7, 1974 United Kingdom ..... 34898/74

[51] Int. Cl.[2] ..... D21F 1/60

[52] U.S. Cl. ..... 162/214; 162/217; 162/357; 162/370

[58] Field of Search ..... 162/317, 318, 357, 370, 162/371, 214, 217, 306

[56] References Cited

U.S. PATENT DOCUMENTS

| | | | |
|---|---|---|---|
| 2,658,430 | 11/1953 | Stevens | 162/317 |
| 3,205,126 | 9/1965 | Clink | 162/317 |
| 3,321,360 | 5/1967 | Holt | 162/317 X |
| 3,547,777 | 12/1970 | DeNoyer | 162/317 X |

*Primary Examiner*—S. Leon Bashore
*Assistant Examiner*—Richard V. Fisher
*Attorney, Agent, or Firm*—Lowe, King, Price & Markva

[57] ABSTRACT

A method for preventing web rewetting in a paper making machine of the type comprising a forming cylinder with an apertured or perforated periphery, with or without a foraminous belt wrapped around the cylinder, on which cylinder there is formed, during rotation of the cylinder, a paper web by a pressure slice to which paper slurry or stock is supplied, the paper web remaining on the periphery of the cylinder or belt over a major portion thereof, while water is drawn from the web by means of one or more suction boxes located within the cylinder and extending from the pressure slice to a transfer zone where the web is transferred from the cylinder or belt onto a felt or wire cloth for subsequent processing. In the remainder of the paper making machine there is provided a suction box extending over an arc from said web transfer zone to the area of said pressure slice to prevent rewetting of the withdrawn web.

3 Claims, 1 Drawing Figure

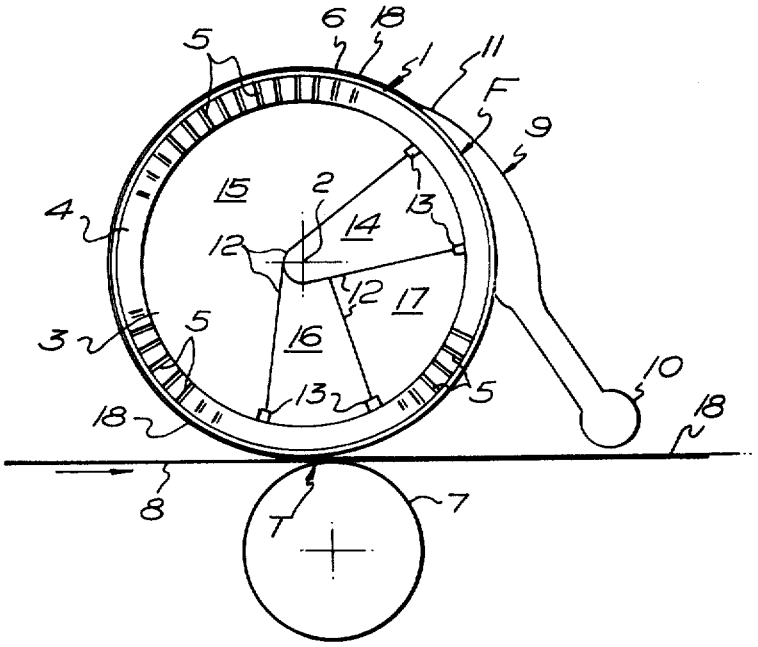
5
6
18
1
11
F
9
15
2
13
4
14
12
12
17
3
5
16
10
13
5
18
18
8
7
T

METHOD FOR PREVENTING WEB REWETTING

This invention relates to paper making machines of the type comprising a forming cylinder with an apertured or perforated periphery, with or without a foraminous belt wrapped around the cylinder, on which cylinder there is formed, during rotation of the cylinder, a paper web by a pressure slice to which paper slurry or stock is supplied, the paper web remaining on the periphery of the cylinder or belt over a major portion thereof, while water is drawn from the web by means of one or more suction boxes located within the cylinder and extending from the pressure slice to a transfer zone where the web is transferred from the cylinder or belt onto a felt or wire cloth for subsequent processing in the remainder of the paper making machine. Such a paper making machine is hereinafter described as "of the type referred to".

However, existing designs of paper making machines of the type referred to are limited as regards speed of operation, mainly by the phenomenon of water throw-out from the perforations of the cylinder periphery (and/or any belt) immediately after the transfer zone, due to centrifugal forces, which phenomenon, in the case of a web remaining on the cylinder or belt over a major portion thereof, throws water back on to the web. Such water throw-out is detrimental to the formation of a good quality web, and attempts to obviate the problem have included the attachment of expensive and complicated water collecting trays.

The object of the present invention is to provide a paper making machine of the type referred to in which greater operating speed may be achieved without water throw-out and hence without the need for trays or other means exterior to the forming cylinder to prevent the web being re-wetted.

According to the present invention a paper making machine of the type referred to comprises a suction box extending over an arc from the web transfer zone to the area of the pressure slice.

Thus the invention achieves its stated object by retaining water normally thrown out of the holes by centrifugal forces as "slugs" in the perforations of the cylinder (and/or any belt), until such time as the area of the pressure slice is reached, whereupon, fresh stock issuing from the pressure slice presses the water slugs out of the perforations into the interior of the cylinder for collection by the conventionally provided suction box or boxes. Thus the forming cylinder (and/or any belt) acts as a water carrier until such time as the water is pressed therefrom by incoming stock.

The invention will now be described, in greater detail, by way of examples, with reference to the accompanying diagrammatic drawing.

A forming cylinder 1, rotatable about an axis 2, has a hollow interior 3 defined by a wall 4, the latter being provided with a plurality of radial bores 5. A wire covering or belt 6 is wrapped around the external periphery of the cylinder, and beneath the latter is a transfer roll 7, a felt or wire cloth 8 passing through the nip between the cylinder 1 and roll 7. A pressure slice 9, of known construction, is provided with a feed pipe 10 connected to a source of paper slurry or stock and includes a delivery mouth 11 extending over a segment of the cylinder 1. The interior 3 of the cylinder is divided by walls 12, each carrying air-loaded seals 13 to bear on the cylinder 1, into four succeeding suction boxes 14, 15, 16 and 17 extending in anti-clockwise manner completely around the cylinder 1 and each connected to a source of suction (not shown).

In use, paper stock is fed from the mouth 11 onto the wire covering 6 to create a paper web 18 on the latter at a web forming zone F corresponding generally to the segment embraced by the box 14, water being sucked from the web 18 by the vacuum in the box 14 through the wire covering 6 and the radial bores 5 into the box 14. Rotation of the cylinder 1 conveys the web 18 to the boxes 15 and 16, where vacuum continues to extract water from the web, the box 16 being located at a web transfer zone T, where the web is transferred from the cylinder 1 on to the felt or wire cloth 8 for further processing, but with vacuum maintained in box 17 water contained in the wire covering 6 and in the radial bores 5 over the segment embraced by the box 17 is not thrown back by centrifugal forces on to the web 18 but is retained and a proportion sucked into the box 17 which covers an arc in a region following transfer zone T. This retained water is pressed from the cylinder and covering 6 by the incoming paper stock issuing from the mouth 11. Typical levels of vacuum in the four suction boxes are:

Box 14 — 0–3 inches Hg
Box 15 — 3–6 inches Hg
Box 16 — 3–5 inches Hg
Box 17 — 3–9 inches Hg Without box No. 17, the speed of operation of the forming cylinder shown in the drawing would be limited to approximately one half the speed of operation of the cylinder with box No. 17, but obviously, the maximum speed is dictated by the vacuum levels available for the box No. 17.

What I claim is:

1. In a method of making paper using a paper making machine comprising a forming medium having a perforated surface, a pressure slice adjacent said surface, and a transfer zone from which a formed web is withdrawn, and wherein the withdrawn web is exposed to water thrown out from a length of said forming medium extending between said transfer zone and said pressure slice in a direction of movement of said medium, comprising the steps of moving said medium, supplying paper stock material from said pressure slice to said medium in a forming zone during movement of said medium, producing suction at said medium at the transfer zone thereof, withdrawing the formed web from said medium at the transfer zone, water from said moving medium tending to impinge on said withdrawn web, the additional step of producing suction at said medium along substantially the entire length of said medium extending between the transfer zone and the pressure slice in the direction of movement of said medium so as to prevent rewetting of said withdrawn web.

2. The method of claim 1 wherein said forming medium includes a cylinder and said step of moving includes rotating said cylinder, wherein said additional step includes the step of establishing a plurality of suction zones arranged completely around an internal circumference of said cylinder in a direction or rotation thereof.

3. The method of claim 2, wherein the step of establishing includes establishing four successive suction zones having vacuum levels starting with a zone adjacent the forming zone, respectively, in the range of 0–3 inches Hg, 3–6 inches Hg, 3–5 inches Hg, and 3–9 inches Hg, the last stated vacuum level being maintained along an arc in said length following said transfer zone to an area of said pressure slice in the direction of rotation of said cylinder.

* * * * *